US012158047B2

(12) United States Patent
Anttonen et al.

(10) Patent No.: US 12,158,047 B2
(45) Date of Patent: Dec. 3, 2024

(54) APPARATUS AND METHOD FOR CONTROLLING FLUSHING IN ROCK DRILLING

(71) Applicant: SANDVIK MINING AND CONSTRUCTION OY, Tampere (FI)

(72) Inventors: Pekka Anttonen, Tampere (FI); Timo Setala, Tampere (FI); Tuomo Kivela, Tampere (FI); Sirpa Launis, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/288,292

(22) PCT Filed: Apr. 21, 2022

(86) PCT No.: PCT/EP2022/060503

§ 371 (c)(1),
(2) Date: Oct. 25, 2023

(87) PCT Pub. No.: WO2022/228981

PCT Pub. Date: Nov. 3, 2022

(65) Prior Publication Data

US 2024/0209701 A1 Jun. 27, 2024

(30) Foreign Application Priority Data

Apr. 29, 2021 (EP) ..... 21171309

(51) Int. Cl.
*E21B 21/14* (2006.01)
*E21B 21/08* (2006.01)
*E21B 21/16* (2006.01)
*E21B 45/00* (2006.01)

(52) U.S. Cl.
CPC ..... *E21B 21/08* (2013.01); *E21B 21/16* (2013.01); *E21B 45/00* (2013.01)

(58) Field of Classification Search
CPC .... E21B 21/013; E21B 21/0135; E21B 21/16; E21B 21/14
See application file for complete search history.

(56) References Cited

U.S. PATENT DOCUMENTS 3,308,894 A * 3/1967 Reinhart ..... E21B 21/16 175/50
4,316,514 A * 2/1982 Jysky ..... B01F 35/181 55/432
5,944,122 A 8/1999 Cheers
8,813,870 B2 8/2014 Jiao et al.
(Continued)

FOREIGN PATENT DOCUMENTS

WO 2010034889 A1 4/2010

*Primary Examiner* — Kipp C Wallace
(74) *Attorney, Agent, or Firm* — Corinne R. Gorski

(57) ABSTRACT

An apparatus, method and computer program product for controlling flushing in rock drilling, and a rock drilling rig. The apparatus includes a control unit and a computer program for controlling feeding of a liquid component in an air mist flushing system in response to detected penetration rate of executed drilling. An operator may set a desired moisture target value for drilling cuttings removed from a drill hole and the control system automatically adjusts the flushing system to control the feeding of the liquid component.

10 Claims, 4 Drawing Sheets

(56) References Cited

U.S. PATENT DOCUMENTS

| | | | | |
|---|---|---|---|---|
| 10,151,199 | B2 * | 12/2018 | Kuiper | E21B 21/015 |
| 10,428,638 | B2 | 10/2019 | Miller | |
| 11,199,062 | B1 * | 12/2021 | Peterson | E21B 21/066 |
| 2003/0182997 | A1 * | 10/2003 | Williams | E21B 49/005 73/863.53 |
| 2013/0140089 | A1 | 6/2013 | Ahlstroem et al. | |
| 2018/0156022 | A1 * | 6/2018 | Miller | E21B 44/04 |

* cited by examiner

APPARATUS AND METHOD FOR CONTROLLING FLUSHING IN ROCK DRILLING

RELATED APPLICATION DATA

This application is a § 371 National Stage Application of PCT International Application No. PCT/EP2022/060503 filed Apr. 21, 2022 with priority to EP 21171309.4 filed Apr. 29, 2021.

BACKGROUND OF THE INVENTION

The invention relates to an apparatus for controlling air mist flushing of a rock drilling unit in rock drilling. The air mist comprises pressurized air and one or more liquid components. The air mist is used for flushing the drilled holes.

The invention further relates to a rock drilling rig, and to a method and computer program product for controlling the air mist flushing system.

In mines and at other work sites different type of rock drilling rigs are used for drilling drill holes to rock surfaces. The rock drilling rigs are provided with one or more booms and rock drilling machines are arranged at distal ends of the booms. During the drilling dust and larger sized drilling cuttings are formed and there is need to remove them from the drill holes. Therefore, the drilling machine is provided with a flushing device for feeding flushing fluid inside the drill hole via the drilling tool. The flushing media may be air, water, or mist. There are different solutions for controlling the flushing process and feeding of the flushing fluid. However, the known solutions have shown some disadvantages.

BRIEF DESCRIPTION OF THE INVENTION

An object of the invention is to provide a novel and improved apparatus, method and computer program product for controlling air mist flushing, and further to provide a novel and improved rock drilling rig utilizing the disclosed solutions.

The apparatus according to the invention is characterized by the characterizing features of the first independent apparatus claim.

An idea of the disclosed solution is that the apparatus comprises one or more control units for controlling feeding of the air mist comprising pressurized air and one or more liquid components. The control unit is provided with data on penetration rate of drilling. Thereby, the control unit generates control signals for controlling feeding of the one or more liquid components of the air mist in response to the input data on penetration rate. The control unit may also be provided input parameters affecting to executed flushing control.

In other words, moisture content of the fed air mist is adjusted in relation to the data on penetration rate. The penetration rate means progression of a drill bit into the rock in a certain period of time. Typically, the penetration rate is expressed m/min.

The aim of the disclosed solution is to affect to properties of drilling cuttings, removed by the flushing from the drill hole, predominantly by adjusting the amount of the liquid content in the air mist. Further, the purpose is to keep the moisture level of the removed drilling cuttings relative constant despite of possible variations in the penetration rate during drilling of one drill hole. Then the system can react to varying rock characteristics and other external variations, for example.

An advantage of the disclosed solution is that clogging of drilling cuttings and other problems can be avoided when the amount of the liquid content and other flushing parameters in the air mist are adjusted properly. Too high level of moisture may cause clogging. On the other hand, when the level of moisture is too low, then dust may cause significant problems. In this solution the moisture-based flushing not only prevents the clogging and dusting problems but may also save energy and flushing media, and further, may ensure full drilling efficiency and allows to keep the working site and the rock drilling rig cleaner.

Further, the disclosed operator-free flushing control suits well for unmanned drilling processes and remote controlled drilling.

According to an embodiment, the penetration rate can be determined in versatile ways and by means of different sensing means. It is possible to sense movement of a rock drilling machine on a feed beam of the rock drilling unit by means of one or more sensors or sensing devices. Alternatively, it is possible to sense operation of a feed device and to determine for example flow rate of hydraulic fluid fed to a feed cylinder of the drilling unit and to determine the penetration rate on the basis of the sensed flows.

According to an embodiment, the feeding of the liquid component is adjusted automatically when the penetration rate varies due to external factors, such as changes in rock quality. The penetration rate may indicate indirectly rock quality, whereby the moisture content is controlled indirectly in response to rock characteristics.

According to an embodiment, the disclosed solution may also detect drilling parameters selected by the operator and may control the feeding of the liquid component based on that. The operator may decrease penetration rate of the drilling by decreasing impact pressure of an impact device, for example, and may thereby try to improve straightness of the drilled holes when drilling demanding rock. The system may monitor the input drilling parameters and may execute required control for the flushing.

According to an embodiment, the liquid component may be water, water solution or any suitable liquid mixture. According to an embodiment, the control unit is configured to examine each drill hole separately and to execute the disclosed adjustment measures case-by-case for each drill hole. In other words, the control unit is configured to examine each drill hole gradually as the drilling advances and executes the disclosed adjustment measures accordingly.

According to an embodiment, the control unit may be provided with input target value for moisture content of drilling cuttings removed from the drill hole being drilled. The control unit may also determine real value of moisture content of the drilling cuttings and may then compare the input target value and the real value and may adjust feeding of the liquid component on the basis of the comparison.

According to an embodiment, the control unit is configured to communicate with at least one user interface. An operator may input desired target values to the control unit by means of the user interface.

According to an embodiment, the mentioned user interface may comprise a visual display element or graphical element for inputting the target values. The visual or graphical display element may be intuitive and may improve user friendliness.

According to an embodiment, the input target value and real value are relative values.

According to an embodiment, the input target value and real value are percentage values. Thus, the values under examination are percentages of moisture.

According to an embodiment, the control unit is configured to: calculate removal rate of the removed drilling cuttings per time period during the drilling in response to input data on diameter of a drill bit, data on density of the drilled rock material and the penetration rate; calculate required liquid component feed rate in response to the input target value for moisture content and the calculated data on the removal rate of drilling cuttings. In other words, the control unit is configured to determine the real value of the moisture content by means of calculation process. Then, there is no need to provide the control unit with sensing data on the real moisture amount. Thus, in this embodiment an indirect control principle is implemented.

According to an embodiment, the calculated removal rate of the flushed drilling cuttings per time period during the drilling may be called a volumetric penetration rate, since it indicates amount of volume of removed solid rock per time period. Feeding of the pressurized air and the liquid component needs to be adjusted in response to the detected volumetric penetration rate so that the preferable moisture content values can be reached.

According to an embodiment, the control unit is provided with input data on density of the rock material to be drilled, or alternatively, the control unit is provided with sensing data during the drilling process and is configured to determine the density of the rock material in response to the sensing data. The control unit may be provided with a suitable algorithm for executing calculation or determination of the density.

According to an embodiment, the control unit is provided with sensing data on the real moisture of the drilling cuttings removed from the drilled hole, whereby the control unit is provided with feedback control and is configured to control the feeding of the liquid component in response to the input feedback data. In this embodiment there are one or more sensors or sensing devices arranged to sense the moisture of the cuttings. The sensors may be arranged in connection with a dust collection system, for example.

According to an embodiment, the disclosed solution comprises flushing parameters input to the control unit, and the input control parameters comprise data sets on allowed moisture values of moisture content of the drilling cuttings. The allowed moisture values may be determined in practical test and measurements. Further, the data sets may be customized for different drilling situations, rock types, drilling tools, for example.

According to an embodiment, the control unit is configured to prevent control situations wherein the feeding of the liquid component leads to air mist flushing situations outside the allowed moisture values defined by the input data sets.

According to an embodiment, the allowable flushing parameters or data sets are illustrated by means of predefined flushing maps. There may be different flushing parameters and flushing maps which are based on practical studies made for different rock characteristics and drilling tools, for example.

According to an embodiment, the control unit may automatically select such control parameters from the data set on allowed moisture values which minimize feeding of liquid component. In other words, this embodiment utilizes as low moisture content as possible but still takes care of that no significant dusting occurs outside the drill hole during the drilling process. An advantage of this principle is that typically the penetration rate can be higher when the feeding rate of the liquid component is low. The higher penetration rate means more effective drilling and savings in time and expenses. Further, liquid component tanks onboard the rock drilling machine may then be smaller.

According to an embodiment, the control unit is configured to control at least one control element for controlling feeding of the liquid component.

According to an embodiment, the control unit is configured to control at least one liquid component feed valve.

According to an embodiment, the control unit is configured to control at least one pump for controlling feeding of the liquid component. The pump may then serve as the above mentioned control element.

According to an embodiment, the control unit may additionally control feeding of air flow in response to the detected penetration rate. An advantage of the air flow control is that an overflow and spreading of dust can be prevented. Further, remarkable energy savings can be achieved when magnitude of the air can be adjusted according to the actual flushing need.

According to an embodiment, the control unit is configured to control an onboard compressor of a flushing system.

According to an embodiment, the control unit is configured to control air flow supplied from a compressed air line of a mine or work site.

According to an embodiment, the disclosed solution relates to a rock drilling rig. The rock drilling rig comprises: a movable carrier; at least one drilling boom mounted movably relative to the carrier; at least one drilling unit mounted to the at least one drilling boom and comprising a feed beam; a rock drilling machine mounted on the feed beam and a drilling tool mountable to the rock drilling machine; an air mist flushing system for feeding pressurized air and at least one liquid component into a drill hole; and an apparatus for controlling the air mist flushing system. The apparatus is in accordance with any one of the features and embodiments disclosed in this document.

According to an embodiment, the rock drilling rig is provided with an onboard air mist flushing system. Then the rock drilling rig comprises a compressor for generating the pressurized air, and further, there is a tank and a pump for feeding the liquid component. The system further comprises at least one liquid component feed channel provided with at least one feed valve for adjusting flow of the fed liquid component.

According to an embodiment, the rock drilling rig is provided with connection to a water supply line of a mine or work site, or to a compressed air line of the mine or work site, or to both.

According to an embodiment, one or more external flushing media supply sources, such as external reservoirs and systems can also be implemented in the disclosed solution. The supply systems may be mobile.

According to an embodiment, the drilling unit is provided with at least one sensing device for detecting penetration rate during the drilling.

According to an embodiment, the rock drilling rig is provided with at least one sensing device for detecting moisture content of drilling cuttings: removed from the drilled hole during the drilling.

According to an embodiment, the discloses solution relates to a method of controlling flushing in rock drilling. The method comprises: using air mist flushing wherein flushing fluid comprises pressurized air and at least one liquid component; controlling during the drilling feeding of the air mist to a flushing system by means of at least one control unit; detecting penetration rate of the drilling; and controlling feeding of the at least one liquid component of the air mist in response to the detected penetration rate and parameters input to the control unit.

According to an embodiment, the method further comprises keeping moisture content of flushed drilling cuttings constant or substantially constant for each examined drill hole despite of varying penetration rate during the drilling of the drill hole.

According to an embodiment, the method further comprises providing the control unit with a selectable target moisture value for moisture content of drilling cuttings flushed away from the drill hole during the drilling.

According to an embodiment, the method further comprises calculating in the control unit volume of solid matter of the removed and flushed drilling cuttings per time period in response to data on diameter of a drilling tool and the detected penetration rate; providing the control unit with a target value defining relative amounts between the liquid component of the air mist and the calculated volume of solid matter of the drilling cuttings; and controlling the feeding of the liquid component in accordance with the target value.

According to an embodiment, the method further comprises providing the control unit with predetermined data sets defining allowed moisture content of the drilling cuttings; and providing, on a user interface, an operator with assistance for selecting allowable parameters for the air mist flushing used in the drilling.

According to an embodiment, the disclosed solution relates to a computer program product for controlling feeding of air mist flushing in rock drilling. The computer program product comprises program code means configured to execute the steps and procedures disclosed in the previous claims when being run on a computer or a data processing device.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
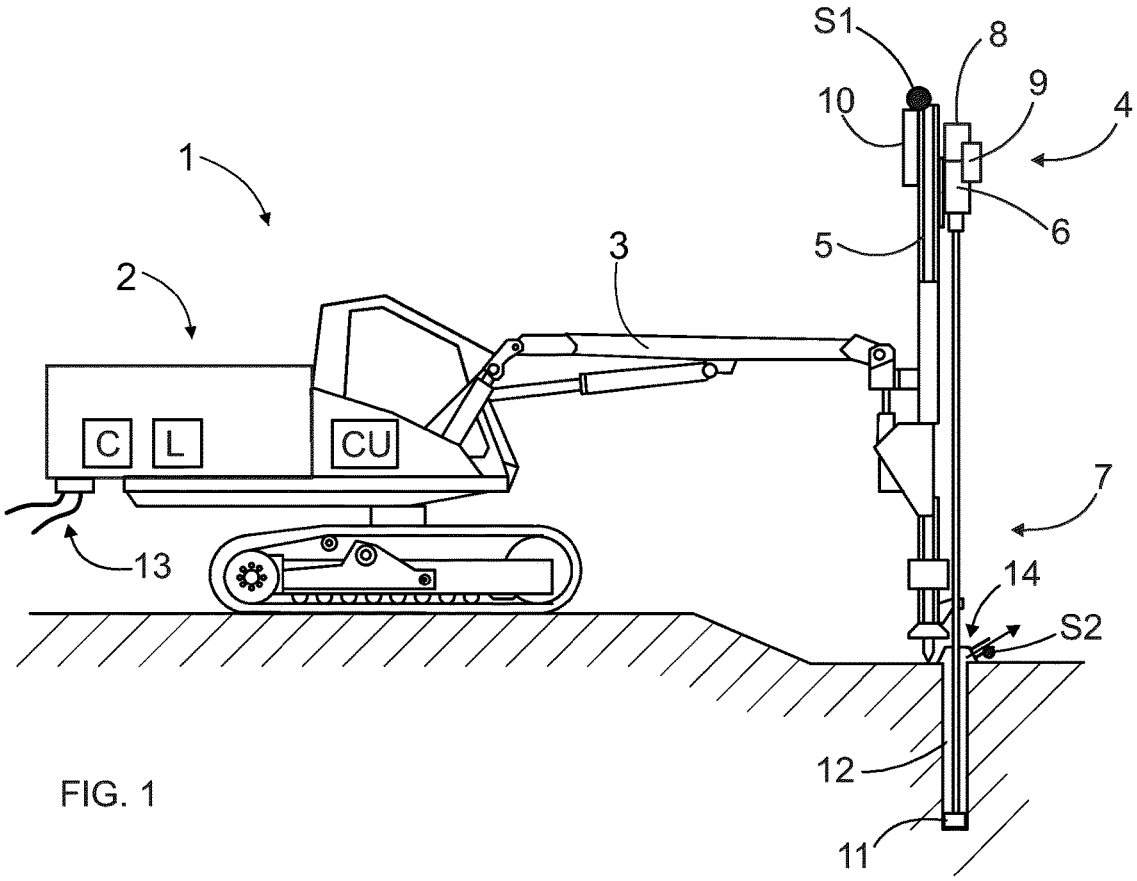
FIG. 1 is a schematic side view of a rock drilling rig for surface drilling and being provided with a drilling unit and system for flushing drilling cuttings.

FIG. 1 shows a rock drilling rig 1 intended for surface drilling. The rock drilling rig 1 comprises a movable carrier 2 and at least one drilling boom 3 connected to the carrier 2. At a distal end portion of the drilling boom 3 is a drilling unit 4 provided with a feed beam 5 and a rock drilling machine 6 supported on it. A drilling tool 7 is connectable to the drilling machine 6. The rock drilling machine 6 may comprise a shank adaptor at a front end of the rock drilling machine 6 for connecting the tool 7. The rock drilling machine 6 may comprise an impact device 8 and a rotating device 9. The rock drilling machine 6 may be moved on the feed beam 5 by means of a feed device 10. At a distal end of the drilling tool 7 there is a drill bit 11. Drilling cuttings are flushed from a bottom of a drill hole 12 during drilling by conveying flushing flow trough the rock drilling machine 6 and the drilling tool 7 to a bottom of the drill hole 12. The drilling tool 7 may comprises tubular extension rods or tubes inside which is a flow channel for the flushing media. The drilling cuttings can move out of the drill hole when the flushing media flows through the drill bit 11.

In the disclosed solution air mist flushing is implemented. Therefore, the carrier 2 may be provided with a compressor C for feeding pressurized air, and a liquid component source L for feeding one or more liquid components, for producing desired flow and composition for the air mist. Alternatively, or in addition to, there may be a feed unit 13 for connecting the carrier 2 to one or more external sources of compressed air and liquid components. For clarity reasons tubes, hoses and other flow channels for conveying the flushing media to the drilling unit 4 are not shown in FIG. 1. The air mist flushing system, and its devices and control elements can be controlled by means of one or more control units CU. The control unit CU may be provided with data on penetration rate and moisture content of drilling cuttings. Therefore, penetration rate may be detected by means of one or more sensors S1, and further, there may be one or more moisture sensors S2 in connection with a drilling cuttings removal system 14.

Figure 2:
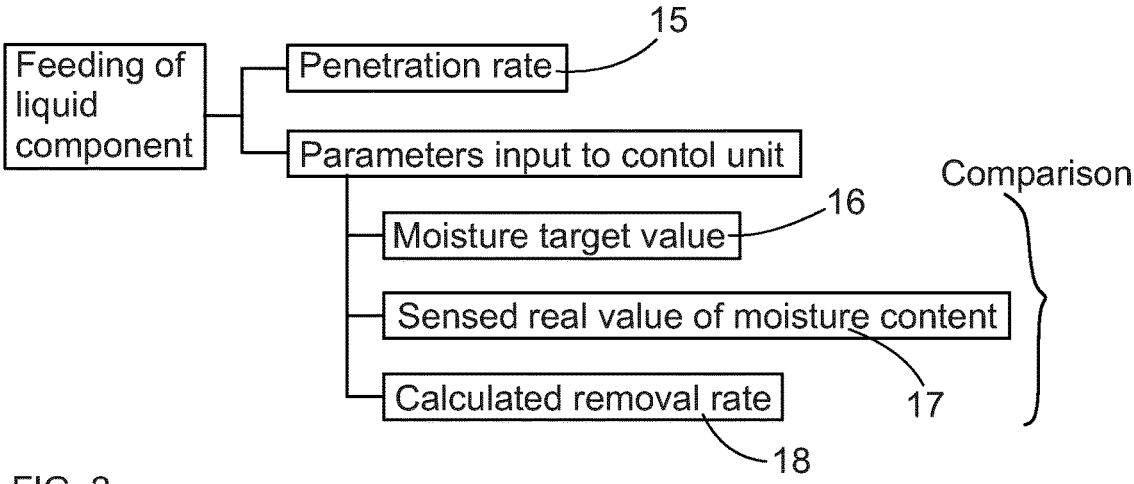
FIG. 2 is a schematic diagram showing some features relating to parameters in the disclosed flushing control.

FIG. 2 discloses that for controlling feeding of the liquid component, penetration rate 15 and moisture target value 16 are input to the control unit. The system may compare sensed real values of moisture content 17 of the drilling cuttings and the moisture target value 16 when generating control signals. Alternatively, the system may calculate removal rate 18 of the removed drilling cuttings per time period during the drilling and may compare the calculated data to the moisture target value 16. The removal rate can be calculated in response to data on diameter of a drill bit, data on density of the drilled rock material and the sensed penetration rate. The diameter D of the drill bit 11 is shown in FIG. 3.

Figure 3:
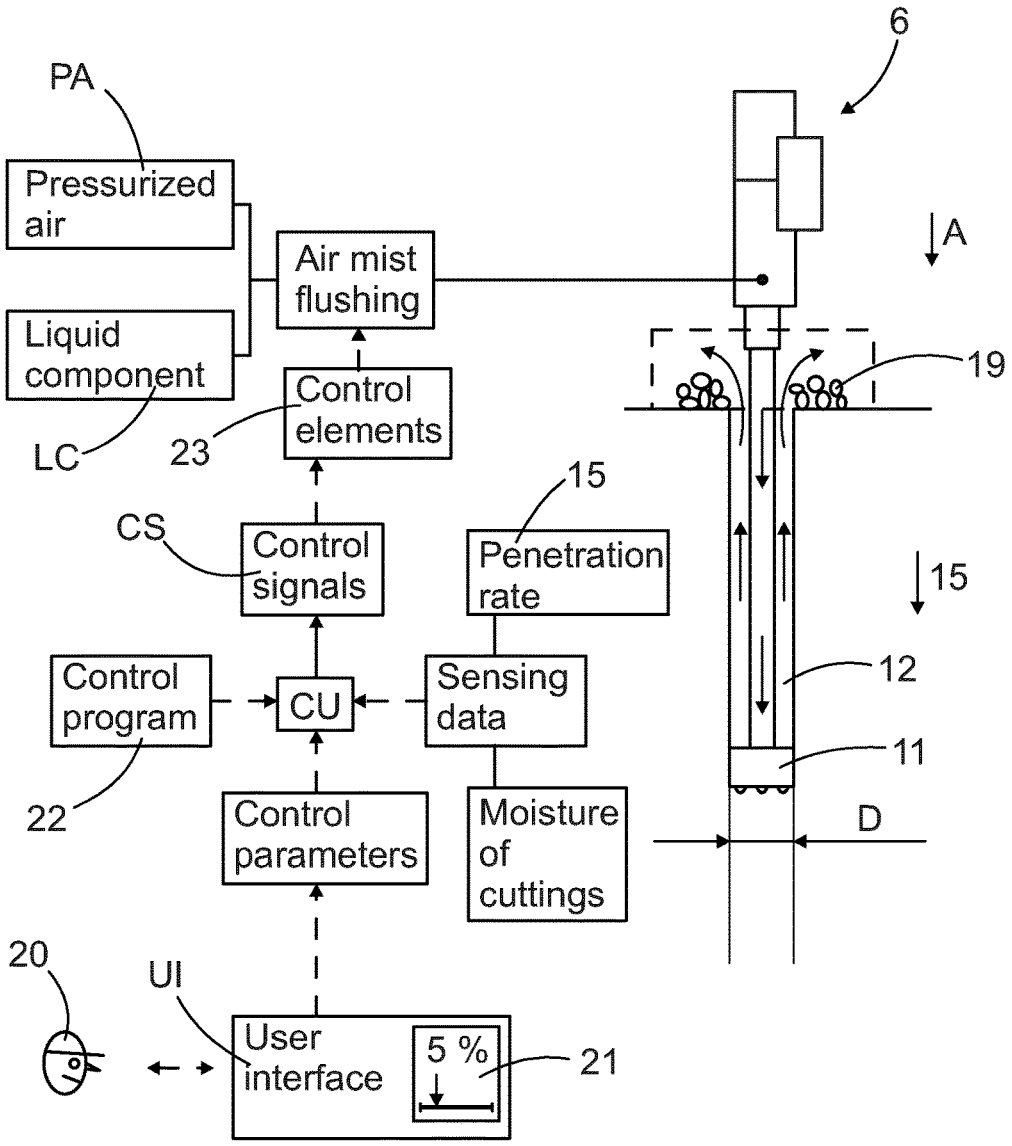
FIG. 3 is a schematic view of an apparatus for controlling air mist flushing.

FIG. 3 discloses features of the disclosed cuttings moisture control system, wherein the purpose is to keep moisture level of the removed drilling cuttings 19 relative constant despite of possible variations in the penetration rate 15 during drilling of one drill hole 12. It is advantageous to implement the disclosed automated flushing process and system in automated drilling processes. An operator 20 may input control parameters to the control unit CU by means of a user interface UI. The user interface UI may comprise one or more graphical elements 21 for assisting feeding of the parameters. There may be a graphical element for showing selected moisture content target value, for example. The target value can be illustrated to the operator visually and in numerical values, such as percentage values. The graphical element 21 may show an allowable range inside which the desired values can be selected so that the operator 20 is assisted or forced to make reasonable selections in intuitive manner. The flushing may be controlled indirectly, since at first the operator selects the desired moisture percentage for the drilling cuttings and then the system calculates the amount of removed rock material during the drilling, and finally the system calculates how much water or other liquid component is needed to achieve the set moisture percentage. The operation is easy for the operator since only the target value needs to be input. The system takes care rest of the control and adjusts the flushing to possible external variations.

The control unit CU is provided with one or more computer program products 22 or control algorithms which may be executed in a processor of the control unit CU. The control unit CU is provided with required input control parameters and sensing data, and is configured to generate control signals CS for one or more control elements 23 controlling at least the feeding of the liquid component LC, and possibly also controlling feeding of the pressurized air PA. The control element 23 may be a pump or valve, for example.

Figure 4:
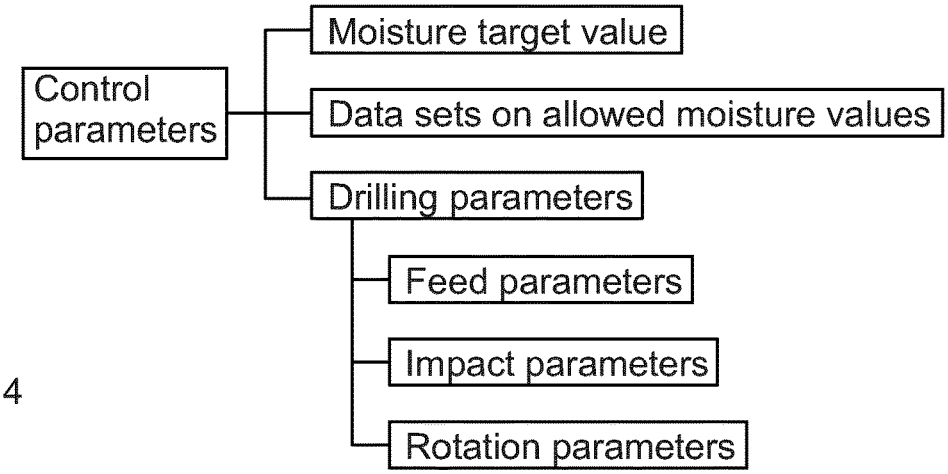
FIG. 4 is a schematic diagram of some control parameters utilized in the disclosed apparatus.

FIG. 4 discloses some control parameters of the drilling and flushing processes. The flushing parameters have been disclosed already above in this document. The drilling parameters may be feed parameters (speed, force), impact parameters (energy, frequency) and rotation parameters (speed, torque). The drilling parameters are also taken into account when controlling the flushing. Further, used drilling tool may have effect on the flushing process control.

Figure 5:
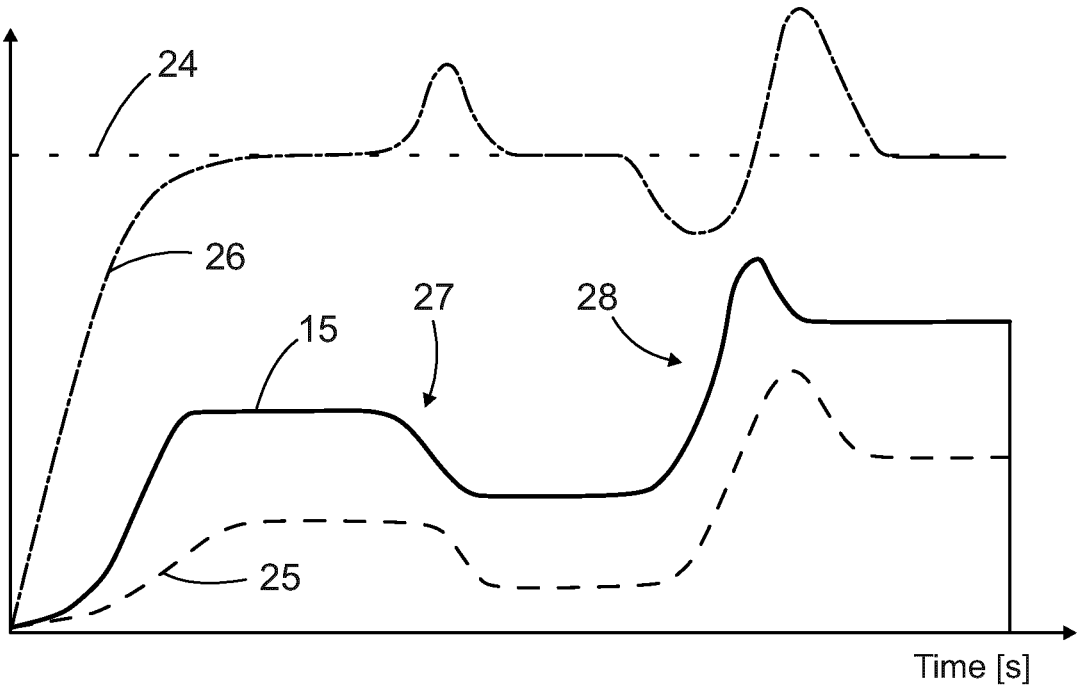
FIG. 5 is a schematic graph illustrating the disclosed control principle.

FIG. 5 shows a moisture target level 24 [%], penetration rate 15 [m/min], sensed flow of liquid component 25 [l/min] and calculated moisture content of drilling cuttings 26 [%] in one combined presentation. The calculated moisture content 26 is calculated on the basis of data on the sensed flow of liquid component 25 and the sensed penetration rate 15. An arrow 27 shows that the penetration rate 15 decreases due to factors external to the drilling control. The drilled rock may be changed to harder, for example. When the penetration rate decreases, the calculated moisture content 26 increases, whereby the flushing control system decreases flow of liquid component, as can be seen when examining the curve 25. Then new balance is found. When the penetration rate increases at an arrow 28, then decrease in the moisture content curve 26 occurs and the system increases feed flow of the liquid component as can be seen when examining the curve 25. Again, new balance is found. Thus, the flushing system takes into account the changes in the penetration rate 15 and tries to keep the curve 26 close to the set target level 24.

Figure 6:
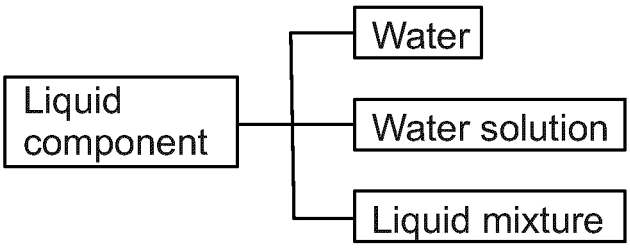
FIG. 6 is schematic diagram showing possible liquid components of the air mist.

FIG. 6 discloses that there may be several alternatives for the liquid component.

Figure 7:
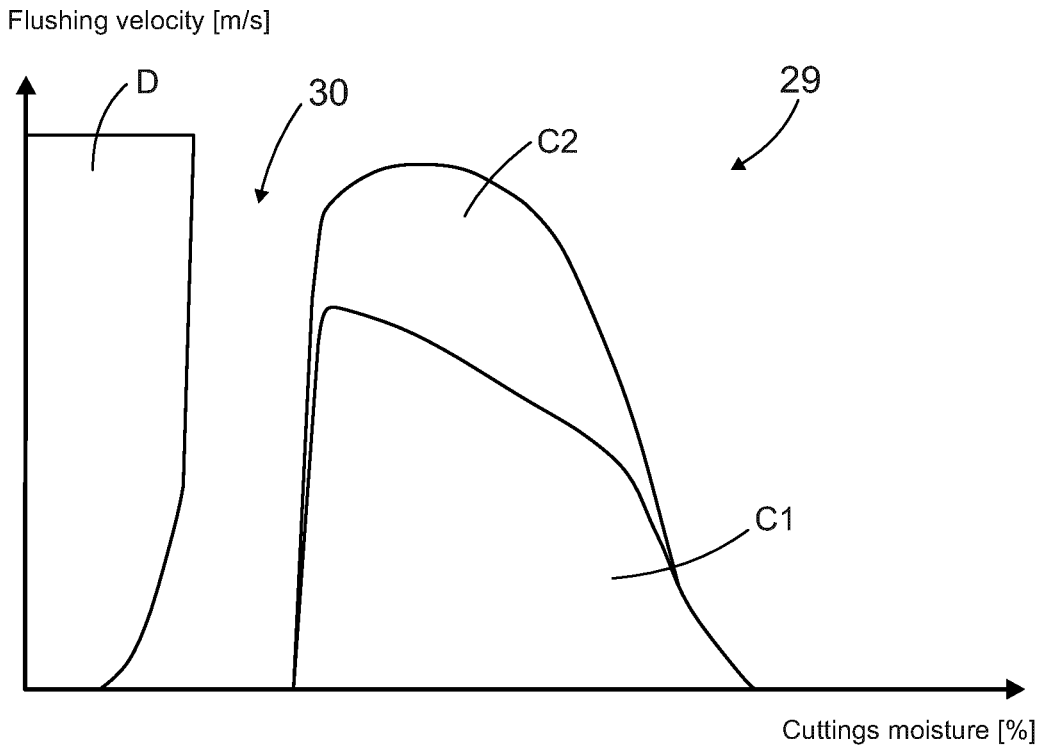
FIG. 7 is schematic graph illustrating a flushing map.

FIG. 7 shows an example of a flushing map 29. Aim of the flushing map 29 is to illustrate flushing parameter values that are allowed. Too low amount of liquid component in the air mist may cause dusting wherefore parameters inside a dusting area D should be avoided. When too high amount of liquid component is used, then there is a risk of clogging. Therefore, operating parameters inside a forbidden clogging area C1 must be avoided. There is also a second clogging area C2, inside which clogging is possible, and that area should also be avoided, if possible. Operating parameters which lead to situations between the areas D and C1, and marked with an arrow 30, should thereby preferred in the flushing control to achieve the improved problem free air-mist flushing. There may be customized flushing maps for different drilling tool and rock types.

The disclosed areas may be defined as data sets for the control unit. Further, the flushing maps and the used flushing parameters may be shown on display device of a rock drilling rig for the operator. This way valuable feed back can be provided for the operator.

The drawings and the related description are only intended to illustrate the idea of the invention. In its details, the invention may vary within the scope of the claims.

The invention claimed is:

1. An apparatus arranged for controlling an air mist arranged for flushing of a rock drilling unit, wherein the air mist comprises pressurized air and at least one liquid component, the apparatus comprises comprising:

at least one control unit arranged for controlling feeding of the air mist, wherein the control unit is provided with input data on penetration rate of drilling, and wherein the control unit is configured to:

calculate a removal rate of removed drilling cuttings per time period during drilling in response to input data on diameter of a drill bit, data on density of the drilled rock material, and the penetration rate, and receive an input target value for a moisture content of drilling cuttings removed from the drill hole being drilled;

determine a real value of the moisture content of the drilling cuttings; and adjust feeding of the at least one liquid component in response to comparison of the input target value and the real value and in response to the calculated removal rate, the control unit being provided with sensing data on the real moisture of the drilling cuttings removed from the drilled hole, whereby the control unit is provided with feedback control and is configured to control the feeding of the liquid component.

2. The apparatus as claimed in claim 1, wherein the flushing parameters input to the control unit comprise data sets on allowed moisture values of the moisture content of the drilling cuttings.

3. The apparatus as claimed in claim 2, wherein the control unit is configured to automatically select such control parameters from the data set on allowed moisture values which minimize feeding of liquid component.

4. The apparatus as claimed in claim 1, wherein the control unit is configured to control at least one liquid component control element.

5. The apparatus as claimed in claim 1, wherein the control unit is configured to additionally control feeding of air flow in response to the detected penetration rate.

6. A rock drilling rig, comprising:

a movable carrier;

at least one drilling boom mounted movably relative to the carrier;

at least one drilling unit mounted to the at least one drilling boom, the drilling unit including a feed beam, a rock drilling machine mounted on the feed beam, and a drilling tool mountable to the rock drilling machine;

an air mist flushing system arranged for feeding pressurized air and at least one liquid component into a drill hole; and an apparatus arranged for controlling the air mist flushing system, wherein the apparatus is in accordance with claim 1.

7. A method of controlling flushing in rock drilling, the method comprising:

using an air mist arranged for air mist flushing, wherein the air mist includes a flushing fluid of pressurized air and at least one liquid component;

receiving a target moisture value for a moisture content of drilling cuttings flushed away from the drill hole during the drilling;

controlling, during the drilling, feeding of the air mist to a flushing system by at least one control unit;

detecting a penetration rate of the drilling; and calculate a removal rate of removed drilling cuttings per time period during drilling in response to input data on diameter of a drill bit, data on density of the drilled rock material, and the penetration rate, calculate a required liquid component feed rate in response to the calculated removal rate of the drilling cuttings;

determining a real value of the moisture content of the drilling cuttings by receiving sensing data on the real moisture content of the drilling cuttings removed from the drilled hole;

adjusting feeding of the liquid component in response to comparison of the input target value and the real value and in response to the calculated removal rate;

wherein the control unit is provided with feedback control and controls the feeding of the liquid component.

8. The method as claimed in claim 7, further comprising keeping the moisture content of the drilling cuttings flushed away from the drill hole constant for each examined drill hole despite of varying penetration rate during the drilling of the drill hole.

9. The method as claimed in claim 7, further comprising:

providing the control unit with predetermined data sets defining allowed moisture content of the drilling cuttings; and providing, on a user interface, an operator with assistance for selecting allowable parameters for the air mist flushing used in the drilling.

10. A computer program product for controlling feeding of air mist flushing in rock drilling, wherein the computer program product includes program code means configured to execute the steps and procedures disclosed in claim 7 when run on a computer or a data processing device.

* * * * *